US005590635A

United States Patent [19]

Piock et al.

[11] Patent Number: 5,590,635

[45] Date of Patent: Jan. 7, 1997

[54] DEVICE FOR INTRODUCING FUEL INTO THE COMBUSTION CHAMBER OF AN INTERNAL COMBUSTION ENGINE

[75] Inventors: Walter Piock; Martin Wirth, both of Hitzendorf; Gunter K. Fraidl, Pirka, all of Austria

[73] Assignee: AVL Gesellschaft Fur Verbrennungskraftmaschinen und Messtechnik m.b.H. Prof.Dr.Dr.h.c. hans List, Graz, Austria

[21] Appl. No.: 605,893

[22] Filed: Feb. 23, 1996

[30] Foreign Application Priority Data

Feb. 23, 1995 [AT] Austria ..... 327/95

[51] Int. Cl.[6] ..... F02M 23/00

[52] U.S. Cl. ..... 123/532

[58] Field of Search ..... 123/532, 531, 123/250, 251, 252, 255, 292, 316

[56] References Cited

U.S. PATENT DOCUMENTS

| | | | |
|---|---|---|---|
| 2,203,669 | 6/1940 | Butler | 123/532 |
| 2,230,920 | 2/1941 | Wirtsen | 123/532 |
| 4,201,160 | 5/1980 | Fenne | 123/532 |
| 5,048,489 | 9/1991 | Fischer et al. | 123/532 |
| 5,119,779 | 6/1992 | Plohberger et al. | 123/250 |

FOREIGN PATENT DOCUMENTS

| | | |
|---|---|---|
| 399991 | 11/1990 | European Pat. Off. . |
| 830589 | 2/1952 | Germany . |
| 4030890 | 4/1992 | Germany . |

*Primary Examiner*—Raymond A. Nelli

*Attorney, Agent, or Firm*—Watson Cole Stevens Davis, P.L.L.C.

[57] ABSTRACT

A device for introducing fuel into the combustion chamber of an internal combustion engine, includes an injection valve for withdrawing compressed gas from the cylinder and injecting the gas together with the fuel into the cylinder, a mixing chamber in the front part of the valve for the purpose of gas storage and into which mixing chamber fuel is introduced via one or more flow passages opening into the mixing chamber, the injection valve being provided with a lifting valve for control of the gas exchange between the combustion chamber and the mixing chamber in the front part of the valve, and an orifice where the flow passage opens into the mixing chamber located in the area of the seat of the lifting valve. To improve mixture preparation in the mixing chamber the fuel flow passage is constituted, at least in part, by a longitudinal bore in the valve stem of the lifting valve, the fuel being introduced into the valve stem in an area of the lifting valve distant from the valve seat, and the flow passage can be closed against the direction of fuel delivery by means of a check valve positioned in the area of the orifice opening into the mixing chamber.

7 Claims, 4 Drawing Sheets

DEVICE FOR INTRODUCING FUEL INTO THE COMBUSTION CHAMBER OF AN INTERNAL COMBUSTION ENGINE

BACKGROUND OF THE INVENTION

The invention relates to a device for introducing fuel into the combustion chamber of an internal combustion engine, comprising an injection valve for withdrawing compressed gas from the cylinder and injecting the gas together with the supplied fuel into the cylinder, with a mixing chamber in the front part of the valve for the purpose of gas storage, into which mixing chamber fuel may be introduced by one or more fuel flow passages opening into the mixing chamber, the injection valve being provided with a lifting valve for control of the gas exchange between the combustion chamber and the mixing chamber in the front part of the valve, and the seat of the lifting valve separating the mixing chamber from the combustion chamber, the orifice of the fuel flow passage opening into the mixing chamber being located in the area of the seat of the lifting valve.

For extremely lean operation a reproducible stratification of the fuel-gas mixture must be obtained in the combustion chamber, especially at part-load. This will only be possible if mixture preparation in the mixing chamber can be reproduced with constant results.

DESCRIPTION OF THE PRIOR ART

In EP 399 991 A1 a device of the above type is described, wherein compressed gas is withdrawn from the cylinder during a working cycle and stored temporarily, and is injected into the cylinder together with the fuel during the subsequent working cycle, the withdrawal of a small amount of hot gas from the cylinder being effected with controlled timing via a valve opening into the combustion chamber of the cylinder. Into the mixing chamber formed by the valve chamber, where the previously withdrawn hot gas is stored temporarily, fuel is injected such that an essentially homogeneous fuel-gas mixture is produced. During the subsequent working cycle this fuel-gas mixture is injected into the combustion chamber through the valve opening into the cylinder. Fuel injection takes place via the wall of the mixing chamber, approximately in the middle of the chamber. As a consequence, conditions for mixture preparation in the mixing chamber are less than ideal, and the thickness of the fuel film deposited on the wall of the mixing chamber is non-uniform due to incomplete fuel atomization. For this reason it is difficult to obtain reproducible charge stratification, in particular, in part-load operation.

In DE-40 30 890 A1 a similar fuel-air injection device is presented for two-stroke engines, with a mixing chamber which communicates with the combustion chamber via a lifting valve. Again, the mixing chamber is charged with compressed cylinder gas through the lifting valve, and the gas-fuel mixture produced by the subsequent injection of fuel into the mixing chamber is then injected into the combustion chamber through the lifting valve. The fuel is admitted in the center area of the injection valve, fuel metering being effected via a fuel valve configured as a seat valve in the part of the mixing chamber distant from the seat of the lifting valve. The valve seat of the fuel valve is positioned on or in the mixing chamber, its axis coinciding with that of the lifting valve, and the valve is controlled by the fuel pressure. The fuel valve is preloaded by a spring supported on the control piston or a cross-wall of the housing, the disadvantage of this arrangement being that fuel metering will be inaccurate due to the difference in tolerances between the individual components and the spring. As the valve seat is provided in or on the mixing chamber, a guide is required in the stationary part of the injection valve in order to obtain a sealing function of the fuel valve, which will cause undesirable friction as a consequence of the necessary movement between the metering plunger of the fuel valve and the guide. As fuel injection into the mixing chamber takes place at a relatively large distance from the valve seat of the lifting valve, the quality of mixture preparation in the mixing chamber is subject to considerable variations.

An air-fuel injection nozzle is disclosed in DE 830 589 C, where fuel is mixed with pressurized air admitted through the nozzle, prior to its injection into the combustion chamber with the aid of the pressurized air. This valve is not designed nor suitable for withdrawing compressed gas from the cylinder, however. The fuel flow passage is partly constituted by a longitudinal bore in the valve stem of the lifting valve, the fuel entering the valve stem in an area of the lifting valve distant from the valve seat. The fuel orifices on the valve stem are positioned centrally relative to the mixing chamber, which is convenient for mixture preparation in the instance of compressed-air injection, especially if a homogeneous mixture is to be obtained. On the other hand this method is hardly suitable if mixture stratification is desired in the mixing chamber.

SUMMARY OF THE INVENTION

It is an object of the invention to provide constant and reproducible operating conditions and to improve mixture preparation in the mixing chamber with respect to a reproducible stratification of the mixture in the combustion chamber, especially in part-load operation.

In the invention this is achieved by providing that the fuel flow passage be constituted, at least in part, by a longitudinal bore in the valve stem of the lifting valve, the fuel being introduced into the valve stem in an area of the lifting valve distant from the valve seat, and that the fuel flow passage can be closed against the direction of fuel delivery by means of a check valve positioned in the area of the orifice opening into the mixing chamber. In the vicinity of the injection valve fuel-rich portions of the mixture are built up and ejected into the combustion chamber prior to the other portions during injection of the mixture. The fuel is introduced into the longitudinal bore of the valve stem via an annular groove outside of the mixing chamber and radial bores, for example. Very good fuel atomization is obtained by configuring the orifice as one or more radial sprayer holes in the stem of the injection valve. Fuel atomization may be further improved by providing the wall of the mixing chamber with a bulge or a noselike projection for fuel atomization in the impact area of the fuel stream injected through the orifice. With this configuration the fuel stream discharged from the valve stem will hit the projection where it is finely divided and spread out in fanlike fashion. Providing a check valve in the discharge area of the fuel stream at the valve stem will help prevent vapor bubbles in the fuel supply line.

It is provided in a most favorable variant of the invention that the check valve be configured as an annular lip valve attached to the valve stem, whose lips close around the valve stem and seal the orifice in the closed position of the valve, while in the open position they are lifted elastically by the fuel pressure, and are approximately directed towards the valve seat. The ring sitting on the stem of the injection valve is elastically deformed when subjected to the fuel pressure, thus exposing the injection orifices, the lips of the lip valve intentionally deflecting the fuel stream in the direction of the valve seat and atomizing it.

It is provided in a preferred variant that the orifice of the fuel flow passage be located in an injection area that is separate from the remaining part of the mixing chamber. This will aid mixture stratification in a particularly favorable manner.

Evaporation and preparation of the mixture in the mixing chamber may be further improved by providing the injection valve with a heater element in the area of the mixing chamber. The heater element may be configured as an electrical resistance unit or as a heat exchanger.

In another variant of the invention, which is given special preference, the proposal is put forward that the wall of the mixing chamber be provided with a surface which enhances the primary reaction of the fuel-air mixture by its catalytic action. Due to the catalytic action of the coating on the inside of the mixing chamber primary reactions of the fuel are enhanced such that the ignition of the fuel-air spray after injection into the combustion chamber is accelerated.

BRIEF DESCRIPTION OF THE DRAWINGS

The invention will be further described with reference to the accompanying drawings, showing in FIGS. 1, 2 variants of the injection valve of the invention, in longitudinal section, FIG. 3 a detail of the valve of FIG. 2, FIG. 4 a third variant, FIG. 5 a detail of the valve of FIG. 4, FIGS. 6, 7 further variants of the invention.

Elements of identical function have identical reference numbers.

DETAILED DESCRIPTION OF PREFERRED EMBODIMENTS

Figure 1:
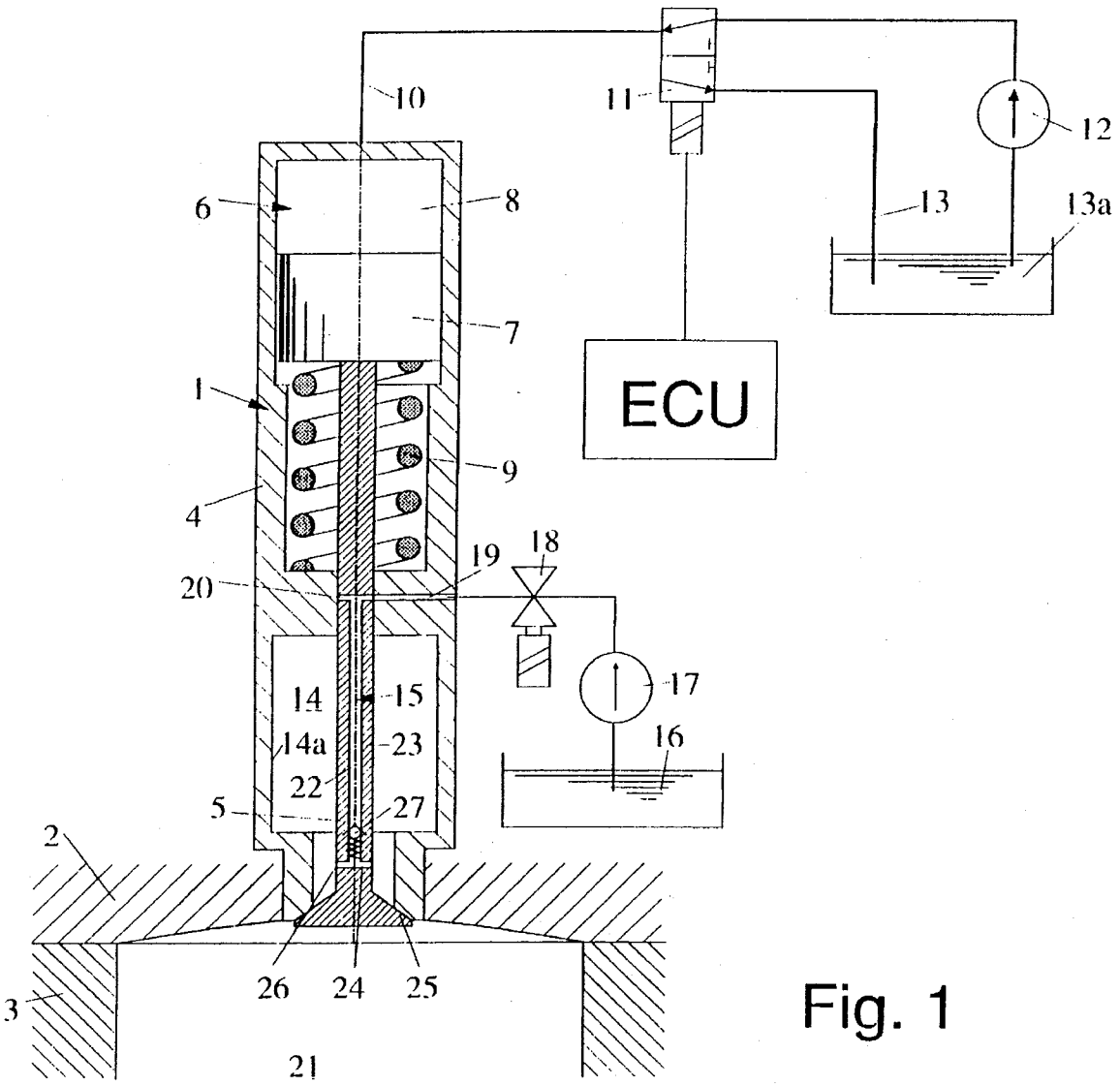

The figures give a schematical representation of an injection valve 1 of an internal combustion engine not shown here in detail. The cylinder head has the reference number 2, a cylinder of the engine is indicated by 3. The injection valve 1 is provided with a lifting valve 5, which slides in the housing 4 of the injection valve 1. The lifting valve 5 is operated by an actuating device 6, for example, a hydraulic unit. This actuating device 6 could also be a pneumatic or electric unit. In the hydraulic actuating device 6 shown in FIG. 1, an actuating plunger 7 of the lifting valve 5 is subject to hydraulic pressure in the pressure chamber 8 against the force of a spring 9, so that the lifting valve 5 is forced open. When the pressure is relieved the lifting valve 5 is closed by the action of the spring 9. A hydraulic line 10 leads into the pressure chamber 8, which line can be connected to a pump 12 or the like by means of a control valve 11. In a second position of the control valve 11 the pressure chamber 8 can be depressurized via a pressure relief line 13. The reference number 13*a* refers to a container for the hydraulic fluid, which could also be fuel. The control valve 11 is operated by an electronic control unit (ECU).

Figures 2, 3:
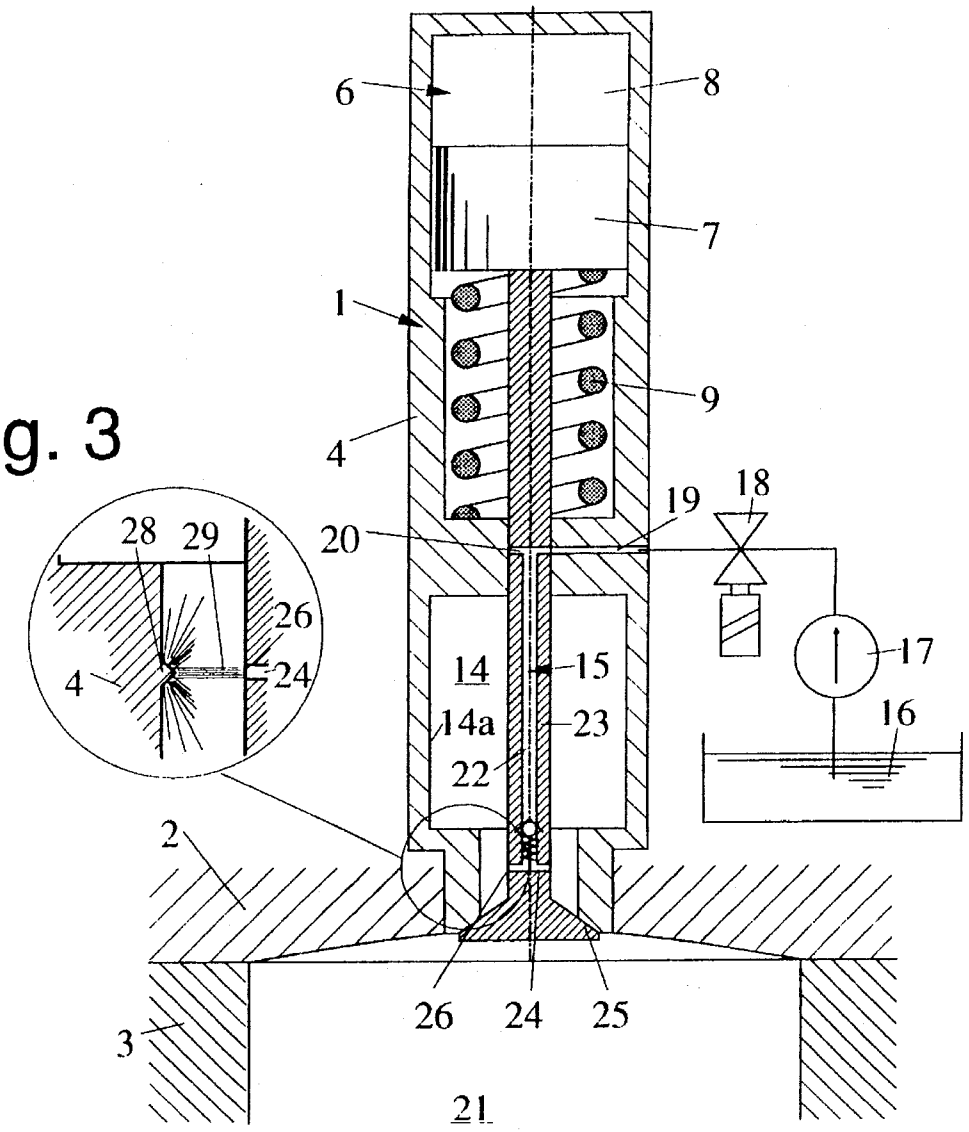

Inside the valve housing 4 a mixing chamber 14 is provided, which is flow-connected with the combustion chamber 21 of the engine when the lifting valve 5 is open. A fuel flow passage 15 opens into the mixing chamber 14, via which fuel can be injected into the mixing chamber 14. The fuel supply system is indicated by the fuel container 16, the fuel delivery device 17, a fuel valve 18 and the fuel flow passage 15 inside the injection valve 1. The fuel flow passage 15 comprises an inlet passage 19 in the valve housing 4, cross-bores 20 in the valve stem 23 in the area of the inlet passage 19, a longitudinal bore 22 in the valve stem 23 of the lifting valve 5, and sprayer holes 24 in the valve stem 23 in the area of the valve seat 25. In the area of the orifices 26 formed by the sprayer holes 24, where the fuel flow passage 15 opens into the mixing chamber 14, a check valve 27 is provided. In the variants of FIGS. 1 and 2 the check valve 27 is directly adjacent to the sprayer holes 24 and the longitudinal bore 22.

In the variant shown in FIG. 2 a projection 28 is provided vis-a-vis each orifice 26 of the sprayer holes 24 opening into the mixing chamber 14. With the aid of this projection 28 the fuel stream 29 discharged from the valve stem 23 is finely atomized. The projection 28 may be configured as a nose or bulged ring, or the like. FIG. 3 shows a detail of the injection valve 1 of FIG. 2, including the projection 28.

Figures 4, 5:
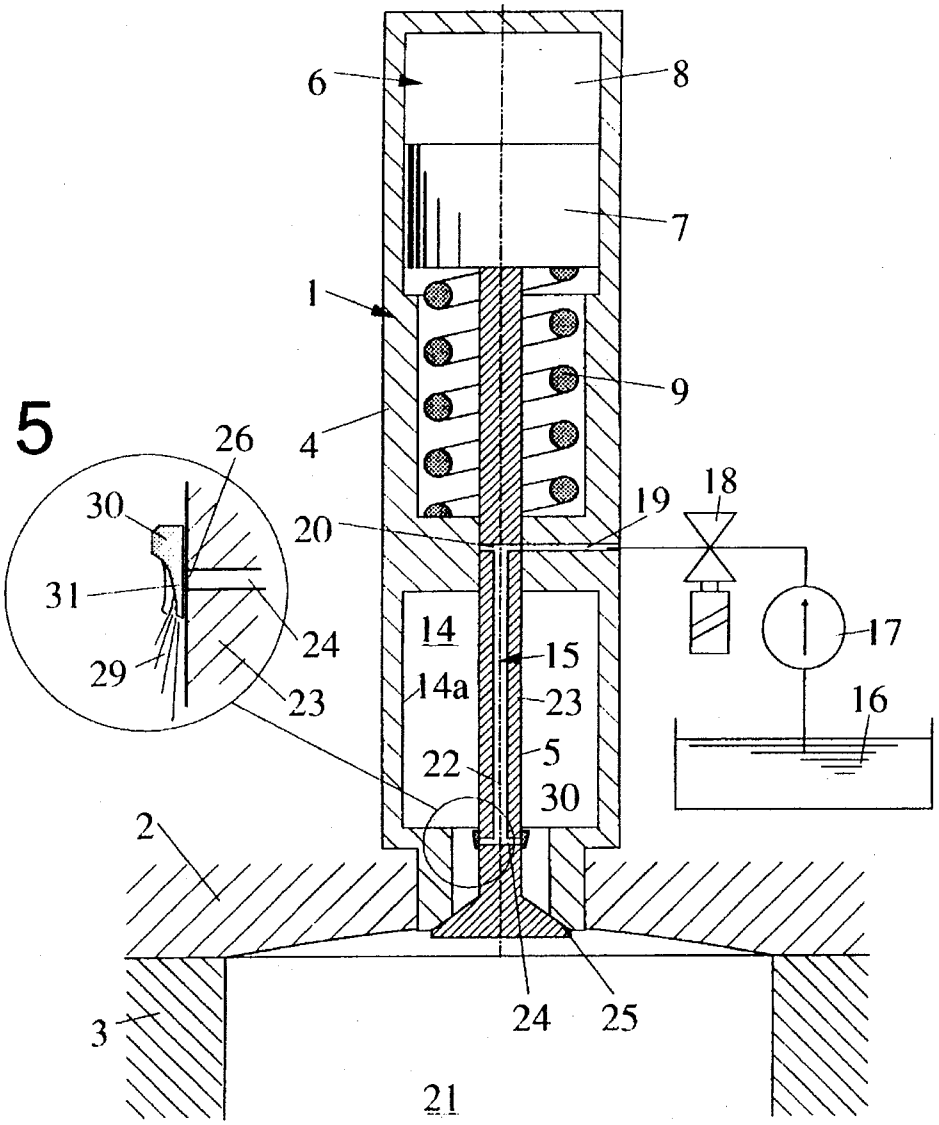

In another variant of the invention, which is presented in FIG. 4, an annular lip valve 30 is provided in the area of orifices 26, which is firmly attached to the valve stem 23 and either replaces the check valve 27 or is used in addition thereto. In their closed position the elastically deformable lips 31 of the lip valve 30, which are directed towards the combustion chamber, will cover and seal the orifices 26 of the sprayer holes 24. By the pressure of the fuel the lips 31 of the lip valve 30 may be elastically lifted from the valve stem 23, such that the fuel stream 29 is divided and atomized, spreading in fanlike fashion towards the valve shaft 23 and the valve seat 25, as is shown in the detail in FIG. 5.

Figure 6:
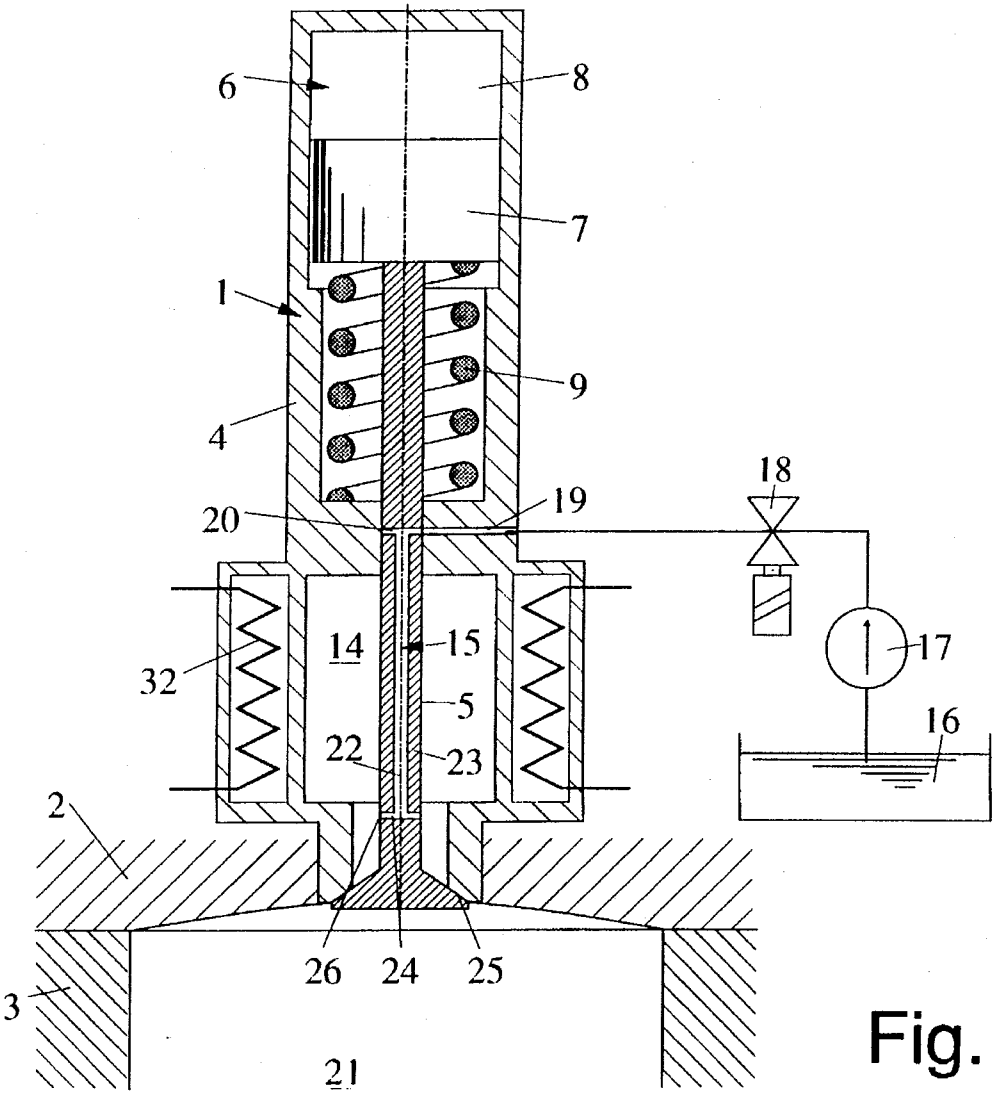

FIG. 6 shows an injection valve 1, whose mixing chamber 14 is heated by a heater element 32, which may be configured as an electrical unit or a heat exchanger. The external heater element 32 may be combined with any of the variants shown (FIGS. 1, 2, 4, 6). The wall 14*a* of the mixing chamber 14 may be coated with, or made from a material enhancing catalytic primary reactions of the fuel and accelerating subsequent ignition of the fuel-air spray in the combustion chamber 21.

Figure 7:
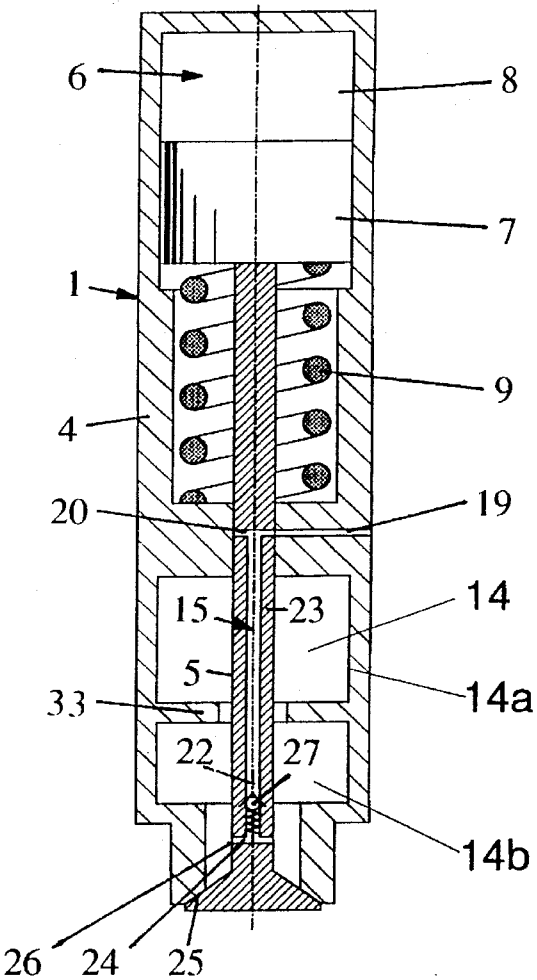

Finally, as is shown in FIG. 7, a separate injection area 14*b* containing the orifice 26 may be provided, which is separated from the rest of the mixing chamber 14 by a partition wall 33. In this way mixture stratification may be improved.

We claim:

1. A device for introducing fuel into a combustion chamber of an internal combustion engine, comprising an injection valve for withdrawing compressed gas from a cylinder and injecting the gas together with a supplied fuel into said cylinder, with a mixing chamber in a front part of said valve for the purpose of gas storage, into which mixing chamber fuel may be introduced by one or more fuel flow passages opening into said mixing chamber, said injection valve being provided with a lifting valve for control of the gas exchange between said combustion chamber and said mixing chamber in a front part of said valve, and a seat of said lifting valve separating said mixing chamber from said combustion chamber, an orifice of said fuel flow passage opening into said mixing chamber being located in the area of a seat of said lifting valve, wherein said fuel flow passage is constituted, at least in part, by a longitudinal bore in a valve stem of said lifting valve, the fuel being introduced into said valve stem in an area of said lifting valve distant from said valve seat, and wherein said fuel flow passage can be closed against the direction of fuel delivery by means of a check valve positioned in the area of said orifice opening into said mixing chamber.

2. A device according to claim 1, wherein said orifice is formed by one or more radial sprayer holes in said valve stem.

3. A device according to claim 1, wherein a wall of said mixing chamber is provided with a bulge or noselike projection for atomization of said fuel stream in the impact area of said fuel stream injected through said orifice.

4. A device according to claim 1, wherein said check valve is configured as an annular lip valve attached to said valve stem, whose lips close around said valve stem and seal said orifice in a closed valve position, while in an open position they are lifted elastically by the fuel pressure and are approximately directed towards said valve seat.

5. A device according to claim 1, wherein said orifice of said fuel flow passage is located in an injection area that is separate from a remaining part of said mixing chamber.

6. A device according to claim 1, wherein said injection valve is provided with a heater element in the area of said mixing chamber.

7. A device according to claim 1, wherein a wall of said mixing chamber is provided with a surface which enhances a primary reaction of the fuel-air mixture by its catalytic action.

* * * * *